US012104445B2

(12) United States Patent
Castellanos Vera et al.

(10) Patent No.: US 12,104,445 B2
(45) Date of Patent: Oct. 1, 2024

(54) INNER TUBING HANDLING DEVICE FOR RECEIVING TUBING FROM DRILLING RIG

(71) Applicant: SAFEDRILL SPA., Santiago (CL)

(72) Inventors: Kevin Alexis Castellanos Vera, Santiago (CL); Nelson Hernando Herrera Roman, Santiago (CL); Eduardo Alfonso Vasquez Hauva, Santiago (CL); Tomás Antonio Buttazzoni Fontaine, Santiago (CL)

(73) Assignee: SAFEDRILL SPA., Quilicura (CL)

( * ) Notice: Subject to any disclaimer, the term of this patent is extended or adjusted under 35 U.S.C. 154(b) by 0 days.

(21) Appl. No.: 18/303,395

(22) Filed: Apr. 19, 2023

(65) Prior Publication Data

US 2023/0392465 A1 Dec. 7, 2023

(30) Foreign Application Priority Data

Jun. 1, 2022 (CL) ..... 202201437

(51) Int. Cl.
*E21B 25/00* (2006.01)

(52) U.S. Cl.
CPC ..... *E21B 25/005* (2013.01)

(58) Field of Classification Search
CPC ..... E21B 25/005
See application file for complete search history.

(56) References Cited

U.S. PATENT DOCUMENTS

| | | | | |
|---|---|---|---|---|
| 2,667,223 | A * | 1/1954 | Farris | E21B 49/082 166/206 |
| 4,043,407 | A * | 8/1977 | Wilkins | E21B 7/124 175/6 |
| 4,628,984 | A | 12/1986 | Noble | |
| 5,004,055 | A * | 4/1991 | Porritt | E21B 7/265 175/203 |
| 5,058,688 | A * | 10/1991 | Scott | E21B 7/265 175/203 |
| 9,957,764 | B2 | 5/2018 | Rutherford | |
| 10,947,793 | B2 * | 3/2021 | Upmeier | E21B 25/02 |
| 2014/0209382 | A1 * | 7/2014 | Smith | E21B 19/14 175/24 |

FOREIGN PATENT DOCUMENTS

| | | |
|---|---|---|
| CL | 2020-01340 | 5/2020 |

* cited by examiner

*Primary Examiner* — Shane Bomar
(74) *Attorney, Agent, or Firm* — Merchant & Gould P.C.

(57) ABSTRACT

A device for handling inner tubes that allows receiving said tubes from the drilling rig to make it available for the extraction of the sample, which reduces operator intervention, reducing risks and facilitates handling of the inner tube, optimizing work times and improves the efficiency of the operation.

20 Claims, 8 Drawing Sheets

INNER TUBING HANDLING DEVICE FOR RECEIVING TUBING FROM DRILLING RIG

CROSS-REFERENCE TO RELATED APPLICATIONS

This application claims the benefit of Serial No.: CL202201437, filed Jun. 1, 2022 in Chile, and which application is incorporated herein by reference. To the extent appropriate, a claim of priority is made to the above disclosed application.

FIELD OF THE INVENTION

The present invention is part of the drilling, probing and mineral exploration industry, specifically, it refers to a device for handling inner tubes that allows receiving said tubes from the drilling tower to make it available for the extraction of the sample, which reduces the intervention of operators, reducing risks and facilitates the handling of the inner tube, optimizing work times and improving the efficiency of the operation.

BACKGROUND OF THE INVENTION

Among the stages of the mineral exploration process is included the drilling or probing stage that aims to make holes or wells that allow characterizing the subsoil through obtaining samples in a study area. Drilling provides information on mineralization, verify grades, and determine mineral resources within the deposit, which makes it possible to evaluate and determine if the study area is economically exploitable.

The most widely used drilling systems are diamond drilling and reverse air drilling:

- Diamond drilling: Uses a diamond core bit to drill through rock, where the bit rotates at one end of a drill rod from a drilling machine. The core bit has an opening at its end that allows a solid core to be cut from the drilled rock that travels up a drill pipe that is located inside the drill rod and is recovered at the surface.
- Reverse air drilling: uses double-walled drill rods that define a center tube and outer tube, where once the ground is drilled compressed air is injected into the outer tube that destroys the rock and the air returns through the center tube of the bars dragging rock fragments, in the form of small chips, which are recovered on the surface.

In the case of diamond drilling, one of the most widely used forms of drilling is rotary drilling. The components that comprise a drilling rig are:

- Work platform: base of the drilling equipment, allows to resist the drilling carried out by the equipment and absorbs vibrations. It must be robust and firm enough to give stability to the drilling equipment.
- Elevation system: includes the equipment that allows holes or wells to be made, the tools that allow the equipment to be moved into or out of said well to extract the cores and recover them on the surface. The main components are:
  - Drilling rig: elongated steel structure for removing and inserting equipment from the hole or well. The drilling tools that allow drilling the rock and extracting cores are located in the tower.
  - Winch: component where the drag cable used to raise the drilling rods and their couplings is wound.

- Drive system: located in the drilling tower, it is in charge of producing the necessary energy for the rotation of the drilling string. The drive system comprises:
  - Transmission: allows to vary the rotation speed and torque of the drilling equipment according to the conditions of the rock in depth.
  - Rotation Head—Used to add and remove drill rods from the drill string. The rotary head is directly connected to the drill string and is responsible for transmitting torque to the string.
  - Power unit: provides the necessary power to the rotating head, commonly correspond to gasoline or diesel engines.
- Drill string: set that includes the components that perforate the rock. This set is responsible for transmitting the torque from the rotation head to the crown bit that perforates the rock and allows the circulation of drilling fluid that lubricates and regulates the temperature of the crown bit. The drill string comprises:
  - Drilling rods: steel tubes with a diameter and length defined by the characteristics of the drilling equipment. They are in charge of transferring the torque and rotation from the equipment to the crown, in addition, serving as a distribution line for the refrigeration fluid.
  - Casing or casing rods: steel tube with a larger diameter than the drill rods, which functions as an artificial wall between the drill rod and the drilled rock. It allows avoiding collapse by stabilizing the drilled ground, preventing the entrapment of the drilling string.
  - Drill pipe, internal or sample: tube installed inside a drilling rod that allows storing the core or sample that the diamond bit cuts from the rock. The tube has a closing mechanism or davit that is connected to one of its threaded ends or heads, where said davit is connected to the winch cable that is used to hoist the tube towards the derrick to later recover the core or shows from the tower.
  - Core drill bit: Located at the front or bottom end of the drill string, the bit is used to cut through rock and extract solid core from the drilled rock through an annular section so that the core is advanced during drilling. drilling and inserted into the drill pipe.
- Pumping system: continuous fluid feed system used to cool and lubricate crown bit tips, rods and all necessary components that have a high percentage of temperature rise during drilling, plus the fluid cleans debris from the ground lodged at the bottom of the well transporting them to the surface. The coolant fluid is typically water or mud with additives to extend the life of drillstring components. The pumping system includes:
  - Mud Pump: Allows the circulation of water or mud in the drill string from the fluid source to the bottom of the drilled hole so that the flow is as constant as possible.
  - Injection head: device comprising a fixed section and a rotating section, where hoses are connected to the fixed section that receive the fluid from the mud pump and inject it into the drilling rods, making it circulate to the bottom of the well. The device is coupled with the upper end of the drill rods by means of a patero in the swivel section of the device that allows the rotation of the drill string preventing the rotational movement of the hoses.

The previously described components are large and heavy, where said components in the currently used systems must be commonly handled manually by site operators, which involves handling drilling rods, drilling tubes and the sample, being said risky operation being carried out under a series of risks to which the operators are exposed as well as the constant errors in carrying out said procedure, which translates into a less efficient and more expensive operation.

In particular, the handling of the perforation or inner tubes can be complex when generating suspended loads, which are a major cause of accidents at work.

In addition, it will be necessary to manipulate the drilling or internal tubes in order to proceed with the extraction of the core or sample stored inside and obtained during drilling. Commonly, this operation is carried out by more than one operator who must extract the inner tube from the drill string in order to remove it from the derrick and manipulate it in preparation for sample extraction, which can be a complex process.

In this regard, it is relevant to reduce the intervention of personnel in the manipulation of the inner tube from the time it is removed from the perforation string until the preparation of said tube for the extraction of the sample.

PRIOR ART

In the state of the art, solutions have been developed for the handling and processing of inner tubes or sample tubes.

In this regard, mention may be made of document U.S. Pat. No. 9,957,764, which describes a cutting apparatus for cutting an inner tube longitudinally for visual inspection of a sample inside, the apparatus comprising a support track to support the tube in at least one position. cutting; at least one cutting assembly mounted with respect to the track, including at least one cutting tool; and a drive arrangement for providing relative movement of the at least one cutting assembly along the support track. This document is directed to providing an apparatus that allows a visual inspection of the sample in the inner tube, however, it does not facilitate the handling of the inner tube to be received once removed from the drilling site.

Another document to be considered is application CL202001340 that discloses a sample extractor system for inner tubes that includes means to remove said tubes from the perforation string, by unhooking the jib from the inner tube to arrange it in a sample lowering assembly for its removal, without staff intervention. Although this system facilitates handling for removal of the inner tube from the derrick, this document does not address the subsequent operations for processing the inner tube to prepare it for sample extraction.

Another relevant document corresponds to U.S. Pat. No. 4,628,894, which describes an apparatus for longitudinally dividing an elongated tube comprising a stratigraphic sample to expose said sample, wherein the apparatus comprises: cutting means connected to a frame and oriented in a horizontal plane; a support to position the tube so that its longitudinal axis is parallel to the plane of the cutting means; and advancing means to move the support and bring the tube into contact with the cutting means. This document is aimed at providing an apparatus that allows exposing the sample without chemically contaminating it, wherein said apparatus cuts the tube and the sample through a plane parallel to the horizontal dividing the sample content into at least two parts, altering its structure, where no reference is made to how to facilitate the handling of the tube since it is withdrawn from the drilling site.

The solutions developed in the prior art disclose devices for the processing of sample tubes in which said tubes must be cut longitudinally to inspect or extract the samples, however, the use of a device that allows the manipulation of the samples is not considered or described. inner or sample tubes from when they are withdrawn from the derrick or drilling site in preparation for sample extraction, where personnel intervention is reduced, and it is not necessary to make complex cuts in the tubes in order to proceed with the extraction of the samples.

In this way, none of the prior art solutions provides a solution that makes it possible to facilitate the handling and processing of the inner tubes from the time they are removed from the drilling rig or from the drilling site until their preparation for the extraction of the sample, reducing personnel intervention, reducing risks and facilitating the handling of the inner tube, optimizing work times and improving the efficiency of the operation.

SUMMARY OF THE INVENTION

The invention discloses a device for handling inner tubes that allows receiving said tubes from the drilling rig to make them available for the extraction of the sample, which reduces the intervention of operators, reducing risks and facilitates the handling of the inner tube, optimizing the results. working times and improves the efficiency of the operation.

The device allows receiving the inner tubes from the perforation strings, a commonly inclined position, to place them on a support that includes a carriage which moves along said support, whose function is to hold the inner tubes to place them in a horizontal position on said support. The support includes moving parts that allow the tube to be transferred to a press that unscrews a head at the end of the inner tubes, which allows access to the sample, so that the tube is available for sample extraction.

In this way, the device allows a safe operation, eliminating manual manipulation of the inner tubes while the drill works, optimizing work times and improving efficiency.

BRIEF DESCRIPTION OF THE FIGURES

The accompanying drawings are included to provide a further understanding of the invention and constitute a part of this description and further illustrate a preferred embodiment of the invention, where it is seen that.

DETAILED DESCRIPTION OF THE INVENTION

The invention corresponds to a device (1) for handling inner tubes (A) that allows independent operation that reduces operator intervention. This device (1) is responsible for receiving the inner tubes (A) from the probes or perforation strings of an equipment or perforation tower for their handling and processing to make them available for sample extraction. The manipulated inner tube (A) includes a screwed head at one of its ends, which must be removed to gain access to the sample.

The device (1) for handling inner tubes (A) is an independent piece of equipment that can be adapted to any probe or drilling string, which must be positioned following the tube drop line so that it can be caught by the device (1).

Figure 1:
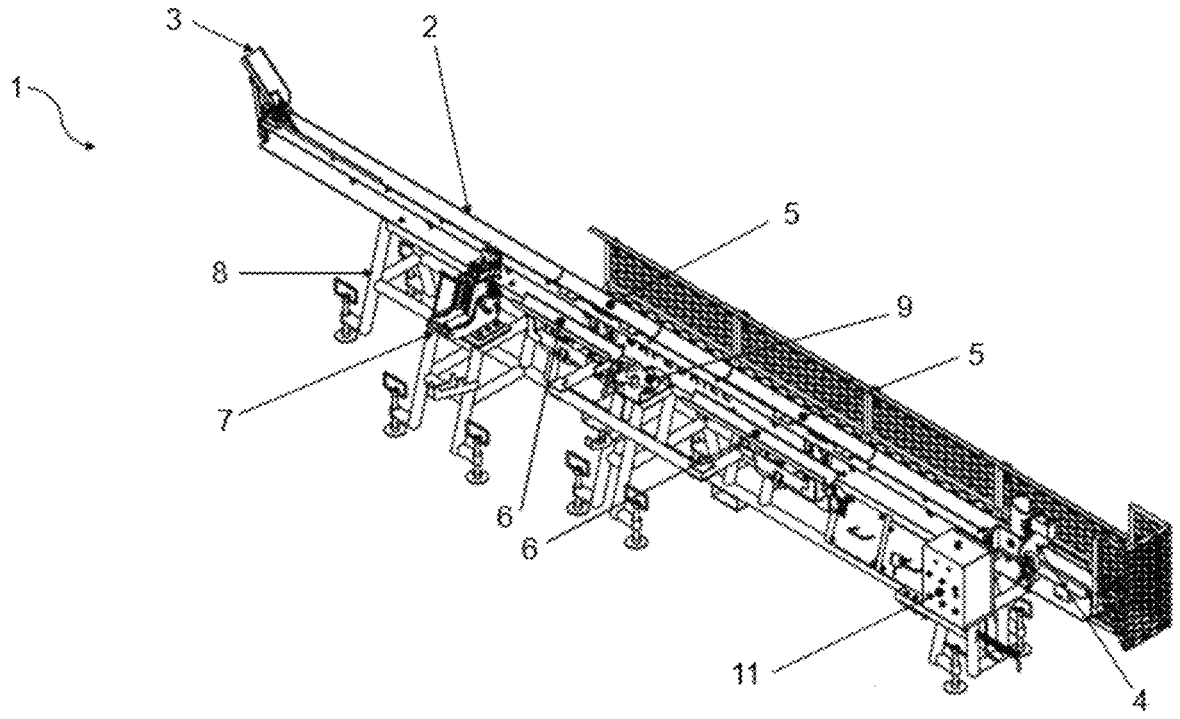
FIG. 1 shows an isometric view of the device for handling inner tubes.

The device (1), as shown in FIG. 1, comprises a supporting structure (2) that receives and supports the inner tubes (A) received from the drilling equipment, which consists of an elongated structure with a semi-cylinder or cylinder section, where the inner tubes (A) can be placed in a horizontal position, so that the longitudinal axis of the inner tubes (A) is parallel to the longitudinal axis of the supporting structure (2); an adjustable extension (3), at one of the ends of the supporting structure (2), responsible for receiving the inner tubes (A) from the drilling equipment, said adjustable extension (3) corresponds to a pivoting element, so that it can vary its angle to adapt to the different operating angles of the probe or drilling string, in this way, the adjustable extension (3) receives the inner tubes (A) in an inclined position; a sliding assembly (4) on the supporting structure (2), which can be moved along it, which includes means to hold the inner tube (A) when it is received by the adjustable extension (3) from the drilling rig and align it and place it in a horizontal position on the supporting structure (2), by varying the position of the sliding assembly (4) with respect to said supporting structure (2); at least one mobile support (5) comprising the supporting structure (2) corresponding to pivoting structures, which can vary their angle to pass through the inner tubes (A) in the device (1) when these are placed on said at least one mobile support (5); at least one transfer arm (6) consisting of a pivoting structure placed on one side of the supporting structure (2) and aligned with the at least one mobile support (5), so that the at least one transfer arm (6) pivots to receive the inner tube (A) from the at least one mobile support (5); a cutting press (7) adjacent to one of the ends of the at least one transfer arm (6), so that it can hold the head of the inner tube (A) and rotate to cut (unscrew) the head.

The adjustable extension (3) has a cylindrical shape to receive the inner tubes (A), where its length is such as to ensure that the inner tube (A) does not fall or come out of the adjustable extension once received. At its lower end, the adjustable extension (3) is pivotally connected to the supporting structure, allowing its angle to be varied. The adjustable extension (3) is also connected to an actuator, in an area close to its upper end to be actuated, allowing the angle of the adjustable extension (3) to be varied without the intervention of a person. In one embodiment, the actuator is a hydraulic cylinder. Alternatively, if required, the adjustable extension can be manually adjusted by an operator to change its angle.

Figure 2:
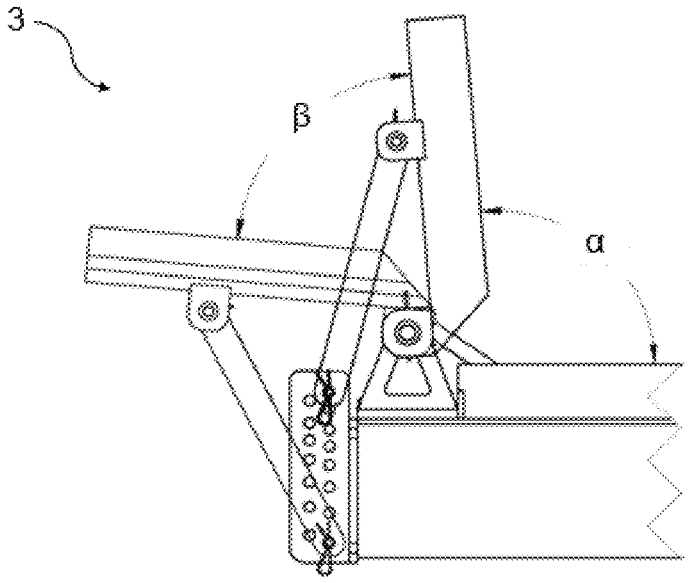
FIG. 2 shows the range of angles to which the adjustable extension of the device can be adapted.

The device (1) is designed to receive the inner tube (A) from the drilling equipment at different degrees of operation. FIG. 2 shows the range of angles to which the adjustable extension (3) can be adapted, corresponding to the angles $\alpha$ and $\beta$. The angle $\alpha$ corresponds to the angle of the adjustable extension (3) with respect to the supporting structure (2) in its initial or rest position and the angle $\beta$ corresponds to the pivoting movement that the adjustable extension (3) can carry out, with respect to its position initial. In a preferred embodiment, the angle $\alpha$ is approximately 95°, while the angle $\beta$ is in a range between 0 and 80°, with respect to the initial position of the adjustable extension (3).

Figure 3A:
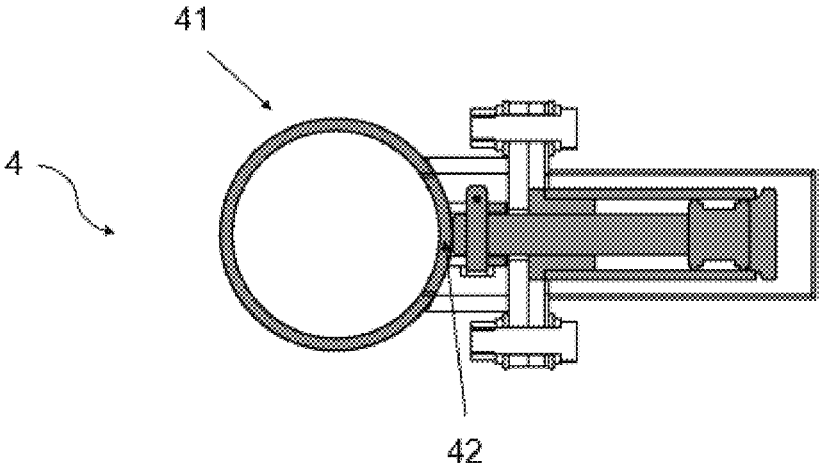
FIG. 3A shows an example of a slider assembly of the device.
Figure 3B:
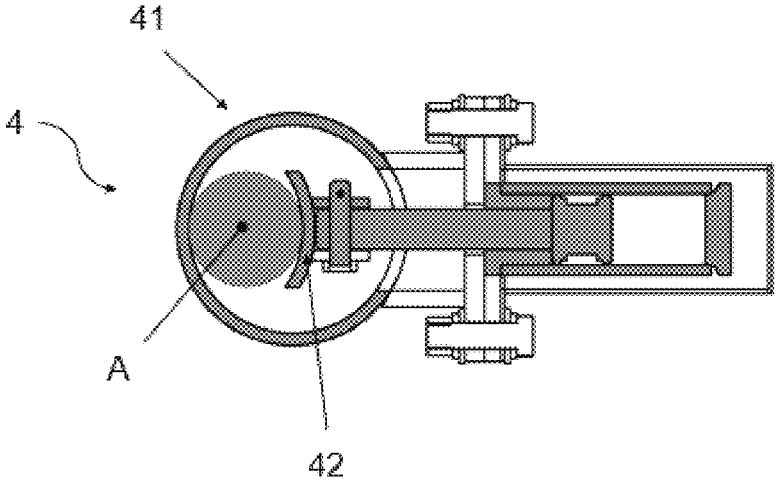
FIG. 3B shows an example of a sliding assembly of the device in a position where an inner tube is retained.

The sliding assembly (4) moves on the supporting structure (2) by means of a rack, being activated by a drive unit on the supporting structure (2), opposite the end where the adjustable extension (3) is. The sliding assembly (4), as shown in FIG. 3A, comprises a receiving element (41) that allows receiving an inner tube (A); and a movable clamp (42) that allows the inner tube to be retained within said receiving element (41). The clamp (42) is actuated to open and close, modifying its position to release or retain an inner tube (A) in the receiving element (41), respectively. To properly receive and secure the inner tube (A), the receiving element (41) has a cylindrical or cylinder section shape, where said receiving element (41) is pivotable to adjust to the position of the adjustable extension (3), and the jaw (42) has a cylindrical or curved section shape to fit the shape of the inner tube (A). FIG. 3A shows the clamp (42) in its initial position, while FIG. 3B shows a position of the clamp (42) when it is retaining an inner tube (A).

The mobile support (5) and the transfer arm (6) are activated by actuators that allow the pivoting movement of these structures. In one modality, said actuators correspond to hydraulic cylinders connected to the mobile support (5) and transfer arm (6), respectively.

The transfer arm (6) is shaped in such a way that it allows the inner tube (A) to be supported and aligned with the cutting press (7). In one modality, the transfer arm (6) has the shape of a semi-cylinder or cylinder section, which can coincide with the shape of the mobile support (5), which coincides, in turn, with the shape of the supporting structure (2) since it is part of it.

Figure 4A:
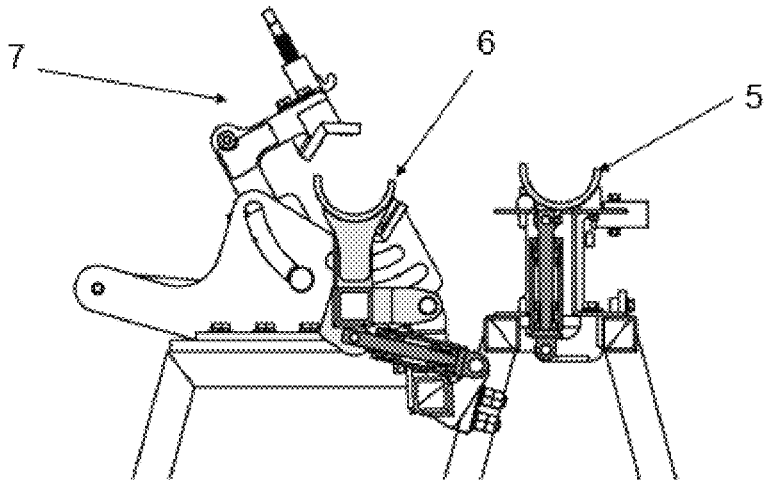
FIG. 4A shows the rest position of a mobile support, transfer arm and cutting press of the device.
Figure 4B:
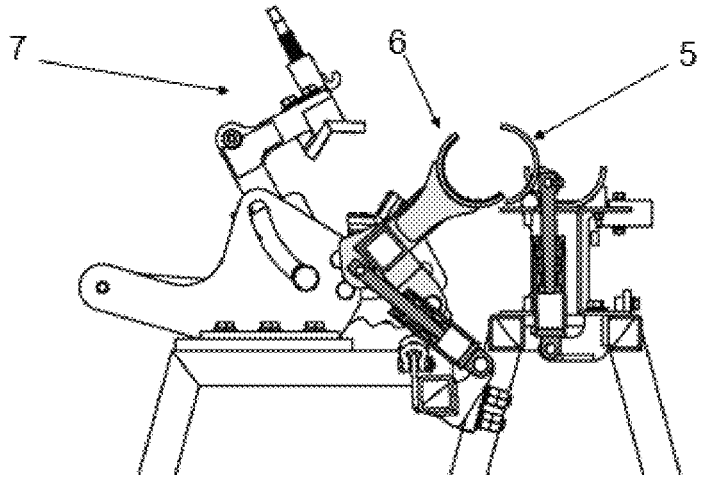
FIG. 4B shows the position of a mobile support and a transfer arm for transferring an inner tube from the mobile support to the transfer arm.

FIG. 4A shows the initial or rest position of the mobile support (5) and the transfer arm (6), while FIG. 4B shows the transfer position of the inner tube between the mobile support (5) and the transfer arm. (6), where the pivoting movement made by the mobile support (5) can be seen to transfer the inner tube (A) to the pivoting arm (6) and the pivoting movement made by the pivoting arm (6) to receive the inner tube (A) from the mobile support, with respect to the initial position shown in FIG. 4A. Once the inner tube (A) has been transferred, the mobile support (5) and the pivoting arm (6) return to their initial position, where it is now the pivoting arm (6) that supports the inner tube (A).

The device (1) can comprise multiple mobile supports (5) and transfer arms (6) depending on the operating conditions, where a preferred modality uses two mobile supports (5) and two transfer arms (6). The number of mobile supports (5) and transfer arms (6) must be the same, where the length of each mobile support (5) coincides with the length of the respective transfer arm (6) with which it is aligned.

Figure 5A:
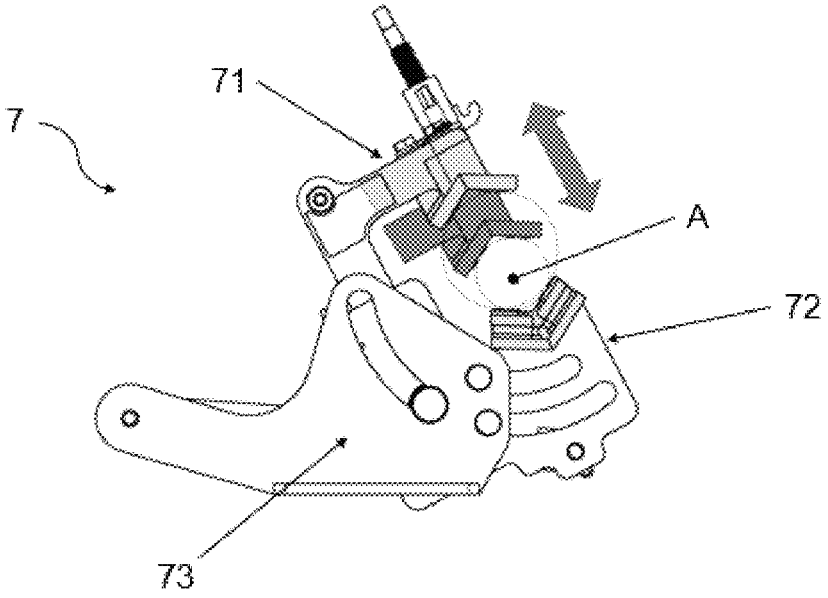
FIG. 5A shows the position of the cutter press to retain an inner tube after being transferred to the transfer arm.

The cutting press (7), as shown in FIG. 5A, comprises a movable jaw (71) and a fixed jaw (72) arranged so that they face each other, leaving a space to place the head of the inner tube (A). The movable clamp (71) can be opened and closed to release or clamp the inner tube head (A), respectively. The jaws (71, 72) of the cutting press (7) are joined together in a body that is pivotally connected to a jaw support (73) that has a slot that allows rotational movement and variation of the jaw. angle of said jaws (71, 72). Rotation of the jaws (71, 72) allows the head to be unscrewed to subsequently remove the sample from the inner tube (A). The opening and closing of the movable jaw (71) is controlled by an actuator and the rotation of the jaws (71, 72) is actuated by a hydraulic cylinder. In one embodiment, the movable jaw actuator (71) is a hydraulic cylinder. Optionally, the movable jaw (71) can be manually adjusted by an operator.

Figure 5B:
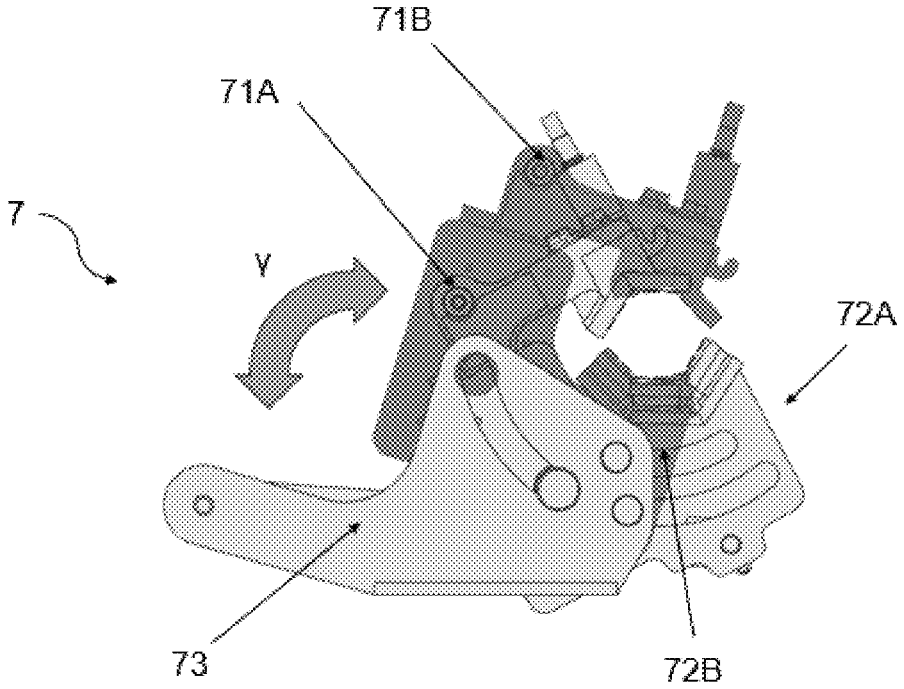
FIG. 5B shows rotation of the cutter press to unscrew the head from the inner tube.

In operation, the cutting press (7) is aligned with the at least one transfer arm (6) so that the head of the inner tube (A) rests on the fixed jaw (71), as shown in the figure. FIG. 5A. In order to unscrew the head from the inner tube (A), the movable jaw (71) is actuated to retain and hold the head, as shown schematically in FIG. 5A. Once the inner tube head is retained, the hydraulic cylinder is actuated to rotate the jaws (71, 72) from an initial position (71A, 72A), to a final unscrewing position (71B, 72B), as shown in FIG. 5B, where the angle γ represents the rotation that the jaws must carry out to unscrew the head. In one embodiment, the angle γ in which to rotate the jaws to unscrew the head is approximately 47° .

Figure 6:
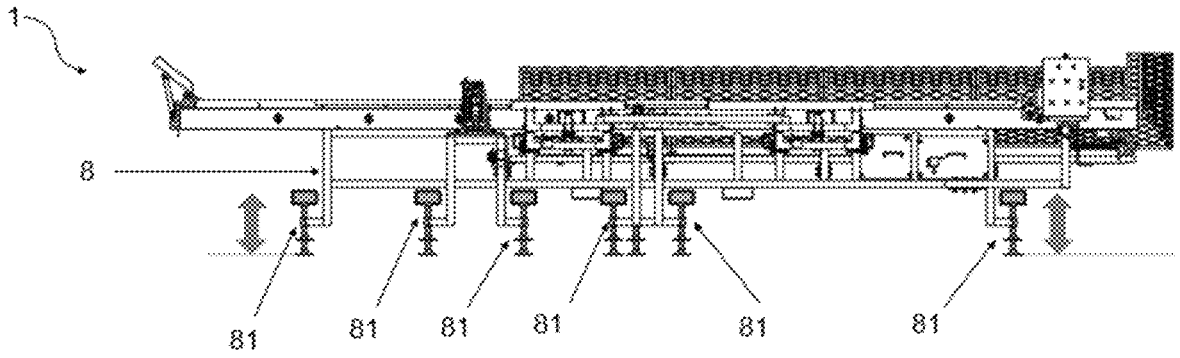
FIG. 6 schematically shows the height adjustment of the support elements of the base structure of the device.

The components of the device (1) can be installed on a base structure (8) that supports and houses all the components, accessories and elements belonging to the device (1). The base structure (8) comprises a plurality of support elements (81) that allow the device to be placed on the ground. Said support elements (81) are adjustable so that they can vary their height to adjust to the terrain where the device (1) is installed, as shown in FIG. 6. The support elements (81) include adjustment means that allow vary the height of these to be rotated.

In a complementary way, the device (1) can include an additional press (9) aligned with the at least one transfer arm (6), making it possible to facilitate the adjustment of the inner tube (A) by providing an additional gripping means that holds and Firm the inner tube (A) so that the cutter press (7) can remove the head. The additional press (9) can be activated by an actuator to regulate its opening and closing. The additional press includes rotation means that allow its position to be adjusted when the cutting press (7) is rotated. In one embodiment, the additional press actuator (9) is a hydraulic cylinder. Optionally, the additional press (9) can be manually adjusted by an operator.

The device (1) also comprises a central energizing system (10), which allows the activation of each of the mobile components of the device (1). The central system (10) is centralized in a main panel, on one side of it. In this, the drive cams are housed that allow each hydraulic component to be controlled independently. It has safety valves that allow the equipment to be disconnected from the hydraulic power circuit.

Figure 7:
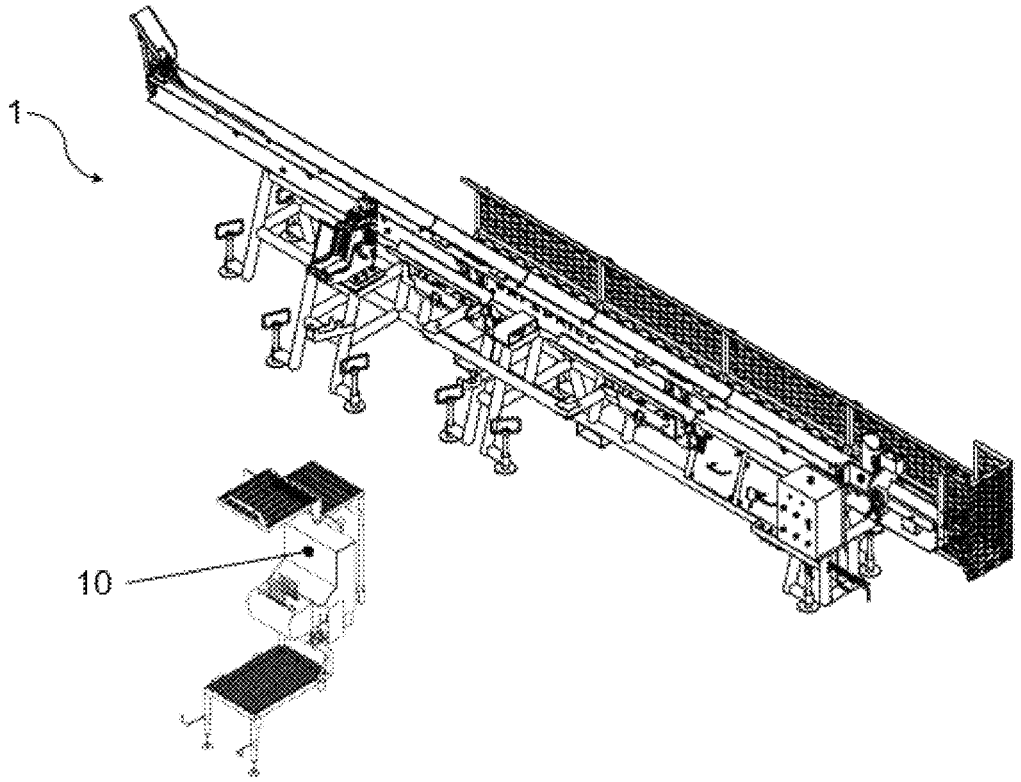
FIG. 7 shows the central energization system, which allows the activation of each of the mobile components of the device.

As shown in FIG. 7, the device (1) is connected to a control panel (11) that contains the electro-hydraulic command so that an operator can activate the movements of the device (1) without intervening directly on it. The control panel (11) can include control means that allow automatic operation each time it requires receiving an inner tube (A) for its preparation for sample extraction.

By virtue of the elements described for the inner tube handling device (1) (A), for its operation, the receiving line and the press line must be considered. The receiving line is where the slider assembly (4) moves, the inner tube (A) is received and placed in a horizontal position. The press line is where the cutting press (7) and/or the additional press (9) is used, as appropriate, to perform the unscrewing process of the head of the inner tube (A). The installation of the device (1) must be adjusted so that the receiving line coincides with the drop line of the inner tube (A) so that it can be caught by the device (1). The drop line of the inner tube (A) will depend on the characteristics of the drilling equipment used and the devices it includes.

Figure 8A:
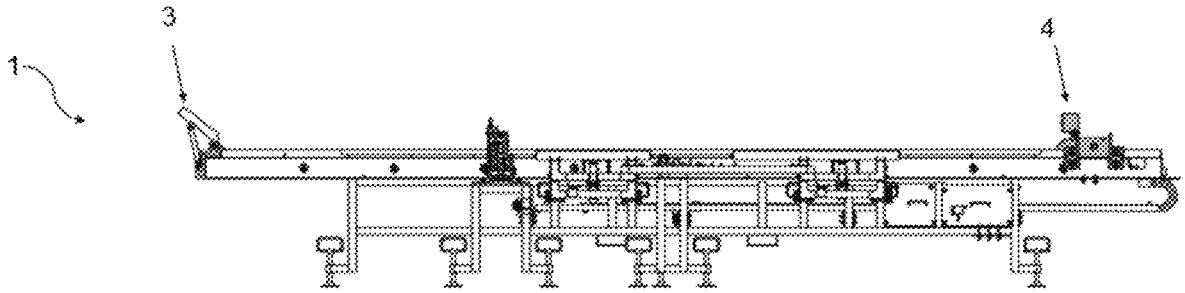
FIG. 8A shows the initial position of the slider assembly before the device receives an inner tube.

During the operation of the device (1), two essential positions of the sliding assembly (4) are considered:

A. Initial or rest position (FIG. 8A): the sliding assembly (4) is in the final position of the stroke that corresponds to the end of the supporting structure (2) where the adjustable extension (3) is not. At this point the drive unit is activated and it is possible to carry out the operation of the system. The sliding assembly (4) can be moved along the entire supporting structure (2).

Figure 8B:
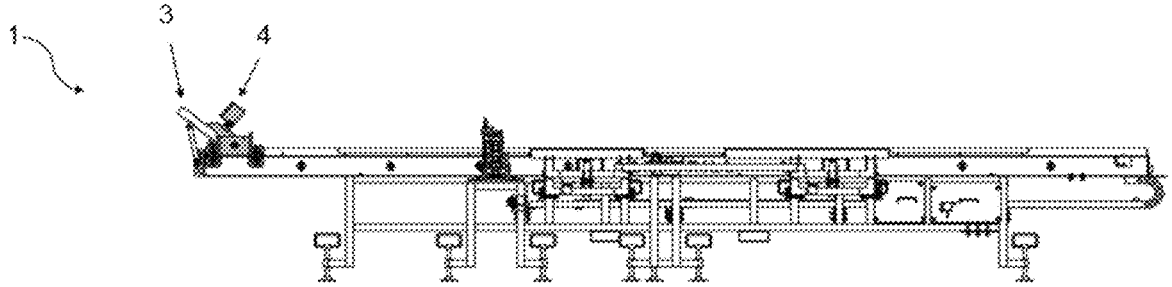
FIG. 8B shows the receiving position of the sliding assembly when the device is to receive an inner tube.

B. Inner tube receiving position (FIG. 8B): the sliding assembly (4) is located at the end of the supporting structure (2) where the adjustable extension (3) is, in this position the receiving element (41) of the assembly slider (4) is aligned to receive the inner tube (A) supported by the adjustable extension (3) previously configured according to the operating angle of the drilling equipment. The slider assembly (4) must be in the receiving position before the inner tube (A) enters the adjustable extension (3) to ensure that it is properly supported by the slider assembly (4).

Once the inner tube (A) is caught and held by the slider assembly (4), the drive unit is started to move the slider assembly (4) and position the inner tube (A) on the supporting structure (2). and on the at least one mobile support (5) to carry out its subsequent transfer.

To ensure correct operation, the leveling of the device (1) must be verified with respect to the ground where it is installed. To adapt to uneven ground, the supporting elements (81) of the base structure (8) must be adjusted by turning the adjustment means until the most horizontal adaptation of the supporting structure (2) is achieved.

Figure 11:
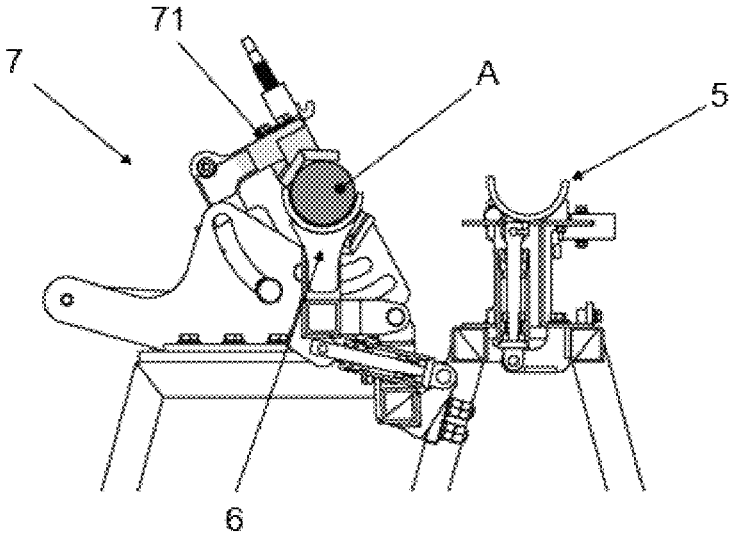
FIG. 11 shows the inner tube being held by the jaws of the cutting press.
Figure 12:
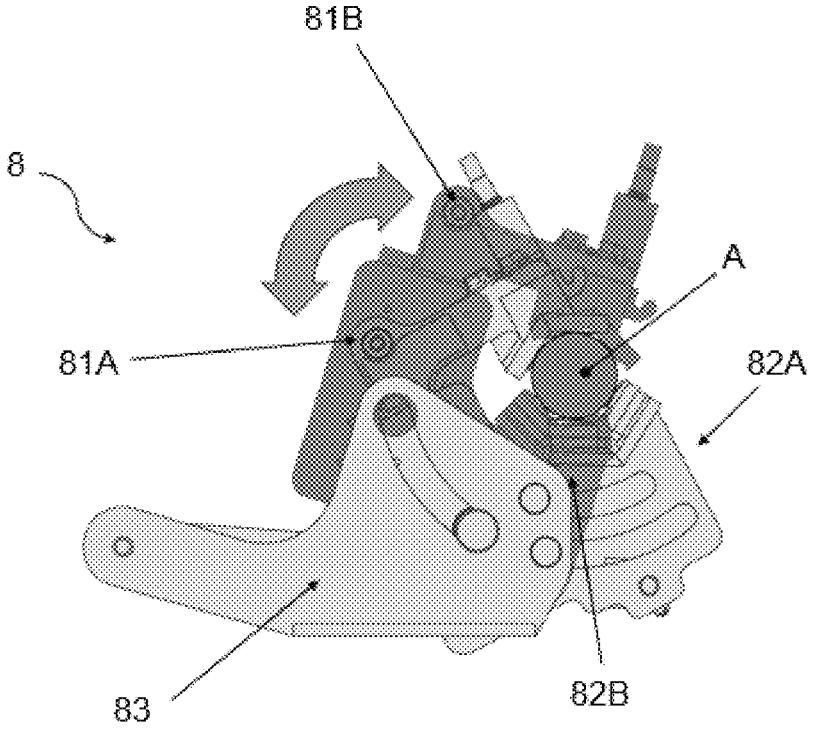
FIG. 12 schematically shows the rotation of the cutter when it is holding an inner tube to unscrew the head.

In a preferred embodiment, the operation of the device (1) starts when drilling with the drilling string is finished. Once drilling is complete, the drill rods and inner tube (A) are removed, the inner tube (A) being disconnected to be prepared for sample extraction. The process of preparing the inner tube (A) for sample extraction comprises the following stages:

i. Move the sliding assembly (4) towards the end of the adjustable extension (3);

ii. Receive the inner tube (A) in the adjustable extension (3) so that the sliding assembly (4) is retained and fastened;

iii. Move the sliding assembly (4) to position the inner tube (A) parallel to the supporting structure (2)

iv. Release the inner tube (A) on the at least one mobile support (5), releasing the inner tube (A) from the sliding assembly (4);

v. Transfer the inner tube (A) from the at least one mobile support (5) to the at least one transfer arm (6);

vi. Hold the head of the inner tube (A) with the cutting press (7) (FIG. 11);

vii. Rotate the cutter press (7) to unscrew the head of the inner tube (A) (FIG. 12);

viii. Release the head of the inner tube (A) from the cutting press (7) and return it to its initial position;

ix. Repeat steps vi, vii , viii until the cap is completely unscrewed leaving the inner tube (A) ready for sample extraction.

It must be taken into account that during stage iv the inner tube (A) must be positioned on at least one mobile support (5) so that the head is aligned with the cutting press (7).

Figure 9:
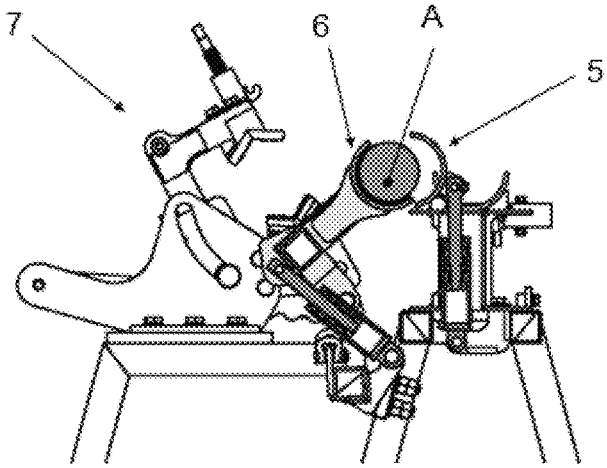
FIG. 9 shows the transfer of an inner tube from a mobile support to a transfer arm
Figure 10:
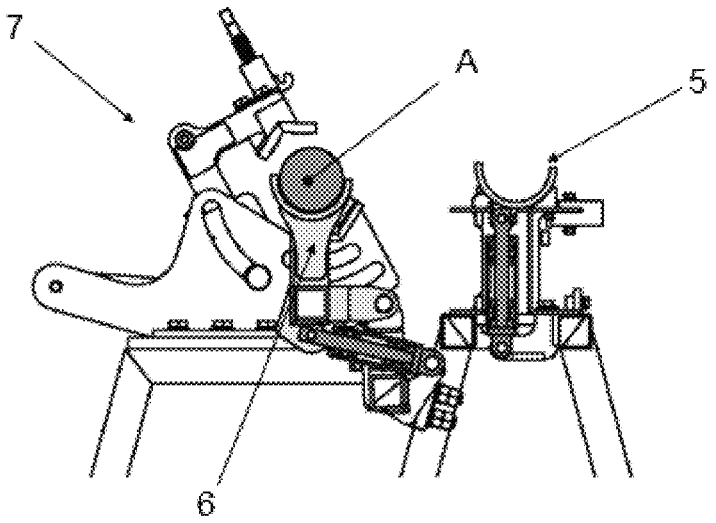
FIG. 10 shows the inner tube in a transfer arm in its initial position.

In step v, the transfer of the inner tube (A) from the at least one mobile support (5) to the at least one transfer arm (6) considers the pivoting, first of all, of the at least one transfer arm (6) to bring it closer to the supporting structure (2) and, subsequently, the pivoting of at least one mobile support (5) with the inner tube (A) to transfer it towards the at least one transfer arm (6), as shown FIG. 9. Once the inner tube is received in the inner tube (A) in the at least one transfer arm (6), said at least transfer arm (6) is returned to its initial position, as shown in the FIG. 10.

In one embodiment, before turning the cutting press (7) the inner tube is retained using the additional press (9).

In one modality, if the ground is uneven, before starting the process, the height of the supporting elements (81) of the base structure (8) must be adjusted until the most horizontal adaptation of the supporting structure (8) is achieved (2).

The inner tube (A) can be received directly from the drilling equipment or previously released by some complementary device, such as the extractor system described in application CL202001340, which allows the removal of the inner tube from inside the perforation, so that it is disconnected from the winch cable before being received in the device (1). In case the inner tube (A) is received directly from the rig, the inner tube (A) must be released from the winch cable when it is placed on the supporting structure (2).

The invention claimed is:

1. A device for handling inner tubes (A) of a perforation string, which allows preparing said inner tubes for the extraction of a sample, reducing the intervention of operators, reducing risks and facilitating the handling of the inner tube, optimizing work times and improving the efficiency of the operation, where the inner tubes (A) include a head at one end that allows access to the sample, comprising:

an elongated supporting structure that receives and supports the inner tubes (A), so that the inner tubes (A) and the supporting structure are parallel in their axial direction, wherein said supporting structure comprises at least one pivoting mobile support;

an adjustable extension, at one of the ends of the supporting structure, which receives the inner tubes (A), being a pivoting element, so that its angle can be varied to adapt to different reception angles of the inner tubes (A);

a sliding assembly on the supporting structure and that can move along it, comprising means to hold the inner tube (A) when it is received by the adjustable extension and allows the tube (A) to be positioned interior on the supporting structure;

at least one transfer arm pivoting to one side of the supporting structure and aligned with the at least one mobile support, so that the at least one transfer arm pivots to receive the inner tube from the at least one mobile support; and a cutting press adjacent to said at least one transfer arm so that it can hold the inner tube (A) to unscrew the head of the inner tube (A).

2. The device according to claim 1, wherein the supporting structure has the shape of a semi-cylinder or cylinder section.

3. The device according to claim 1, wherein the adjustable extension has a cylindrical shape to receive the inner tubes (A), where its length is such that the inner tube (A) do not fall or come out of the adjustable extension once received.

4. The device according to claim 1, wherein the angle of the adjustable extension is adjusted manually or by means of an actuator connected to the adjustable extension in an area near its upper end to be actuated allowing the angle of the adjustable extension to be varied.

5. The device according to claim 1, wherein the adjustable extension, in its initial position, is at an angle of 95° with respect to the supporting structure so that the adjustable extension can vary its angle between 0 to 80° with respect to its initial position.

6. The device according to claim 1, wherein the sliding assembly moves on the supporting structure by means of a rack, being activated by a drive unit.

7. The device according to claim 1, wherein the sliding assembly comprises a receiving element that allows receiving an inner tube (A) being pivotable to adjust to the position of the adjustable extension; and a mobile clamp that allows the inner tube to be retained within said receiving element when it is actuated for its opening and closing.

8. The device according to claim 7, wherein the receiving element has a cylindrical or cylindrical section shape.

9. The device according to claim 7, wherein the mobile clamp has a cylindrical or curved section shape to fit the shape of the inner tube (A).

10. The device according to claim 1, wherein the mobile support and the transfer arm are actuated by actuators that allow the pivoting movement to be carried out.

11. The device according to claim 1, wherein at least one transfer arm has the same shape as the at least one mobile support.

12. The device according to claim 1, wherein the cutting press comprises a movable jaw and a fixed jaw arranged so that they face each other, leaving a space for placing the head of the inner tube (A), being joined together in a body that is pivotally connected to a jaw support that allows rotation and variation of the angle of said jaws to unscrew the inner tube head, and wherein the cutting press can be opened and closed to release or hold the inner tube head (A), respectively.

13. The device according to claim 1, further comprising a base structure that supports and houses all the components, accessories and elements belonging to the device, comprising a plurality of support elements adjustable so that they can vary their height to adjust to a terrain where the device is installed.

14. The device according to claim 1, further comprising an additional press aligned with the at least one transfer arm to provide an additional gripping means that holds and affirms the inner tube (A) so that the cutting press can remove the head and comprises turning means that allow its position to be adjusted when the cutting press is rotated.

15. The device according to claim 1, further comprising a central energizing system, which allows the activation of the at least one pivoting mobile support and the mobile clamp.

16. The device according to claim 1, wherein the device for handling inner tubes (A) is connected to a control panel that contains an electro-hydraulic command so that an operator can activate the movements of the device without intervening directly on the same.

17. The device according to claim 16, wherein the control panel comprises control means that allow automatic operation each time it requires receiving an inner tube (A) for its preparation for sample extraction.

18. A procedure for the manipulation of inner tubes (A) of a perforation string, which allows preparing said inner tubes for the extraction of a sample, reducing the intervention of operators, reducing risks and facilitating the manipulation of the inner tube, optimizing time work and improves the efficiency of the operation, where the inner tubes (A) include a head at one end that allows access to the sample, wherein the procedure includes the stages of:

i. receive an inner tube (A) to be placed in a supporting structure;

ii. move the inner tube (A) along the supporting structure until it is placed on at least one pivoting mobile support;

iii. transfer the inner tube (A) from the at least one movable support towards at least one transfer arm pivoting to the side of the supporting structure and aligned with the at least one movable support;

iv. retain the head of the inner tube (A) with a press cutter;

v. turn the cutter press to unscrew the head of the inner tube (A);

vi. release the head of the inner tube (A) from the cutting press and return it to its initial position;

vii. repeat steps iv, v, and vi until the head is completely unscrewed leaving the inner tube (A) ready for sample extraction.

19. The method according to claim 18, wherein the transfer of the inner tube comprises the steps of:

pivoting the at least one transfer arm to bring it closer to the supporting structure;

pivoting the at least one mobile support with the inner tube (A) to transfer it towards the at least one transfer arm; and return the at least one transfer arm to its initial position.

20. The method according to claim 18, wherein before turning the cutting press the inner tube is retained using an additional press.

* * * * *